United States Patent [19]

Hurner

[11] 4,294,204

[45] Oct. 13, 1981

[54] VEHICLE SPEED LIMITING DEVICE

[76] Inventor: Erwin E. Hurner, 2605 S. Rivershore Dr., Moorhead, Minn. 56560

[21] Appl. No.: 49,307

[22] Filed: Jun. 18, 1979

[51] Int. Cl.[3] ..... F02B 77/00

[52] U.S. Cl. ..... 123/198 DB; 123/390; 123/358

[58] Field of Search ..... 123/198 DS, 198 D, 105, 123/102, 140 A, 139 AZ

[56] References Cited

U.S. PATENT DOCUMENTS

| | | | |
|---|---|---|---|
| 3,590,798 | 7/1971 | Goodwin | 123/198 D |
| 3,661,130 | 5/1972 | Eheim | 123/140 A |
| 3,735,742 | 5/1973 | Aono | 123/32 EL |
| 3,809,028 | 5/1974 | Luchaco | 123/32 CL |
| 3,885,644 | 5/1975 | Seidler | 123/102 |
| 4,020,814 | 5/1977 | Hewitt | 123/198 DB |
| 4,178,901 | 12/1979 | Cunningham | 123/198 DB |

*Primary Examiner*—Ronald B. Cox

*Attorney, Agent, or Firm*—Williamson, Bains, Moore & Hansen

[57] ABSTRACT

A vehicle speed limiting device is designed for use with diesel engines, particularly those in over-the-road trucks. A D.C. pulse generator is attached at the wheel or transmission speedometer pickup and provides a signal to a speed switch which includes a frequency-to-voltage converter which processes the pulse signal. The converter output is then compared to a reference voltage corresponding to a predetermined speed limit, generally 55 miles an hour. When the vehicle speed and corresponding voltage exceeds the reference voltage and speed, the comparator operates a relay which opens or closes a solenoid valve in the fuel supply line of the truck. In most applications, the solenoid valve is placed between the fuel pump and the injector and fuel flow is diverted from the injectors to the upstream side of the pump. A small amount of fuel is allowed to continue to the injectors to provide for proper lubrication thereof.

5 Claims, 4 Drawing Figures

VEHICLE SPEED LIMITING DEVICE

BACKGROUND OF THE INVENTION

The recent shortage of fossil fuels and the rising prices of those fuels has made it increasingly important to conserve energy. Further, the imposition of the 55-mile an hour speed limit has added the force of law behind the efforts to conserve fuel. Thus it is desirable to have a device which will limit the speed of the vehicle in an accurate fashion with a device that is reliable and relatively impervious to tampering by the operator or the mechanic.

Various prior art devices have been proposed but none has been satisfactory for use with diesel-powered vehicles. Prior speed control devices can be grouped into several categories. First are those which act to limit engine speed but which are not useful in limiting vehicle speed since the maximum engine speed in top gear is generally above any vehicle speed limit that would be imposed. The other main group of vehicle speed controllers are those which act to control the linkage of the fuel supply device (fuel injection or carburetor) in an attempt to maintain a predetermined speed. While it has been proposed in U.S. Pat. No. 2,239,328 to partially or completely cutoff the fuel supply when a predetermined road speed has been reached, this previous attempt is not suitable for use with vehicles having injection systems as it does not take into account the special conditions under which such systems must operate. It has been discovered that merely cutting off the fuel supply to the injection pump and injectors will cause those pumps and injectors to become scored and/or seized since the fuel also acts as a lubricant in diesel engines. These parts are highly and carefully machined and it is thus desired to have fuel passing through them at all times.

SUMMARY OF THE INVENTION

A D.C. pulse generator is attached to the front wheel or transmission mounting point of the speedometer drive. The output from the generator is then fed to a frequency-to-voltage converter which produces an output voltage proportional to the frequency of the pulse generator output.

The converter output voltage is compared to a reference voltage which corresponds to a predetermined vehicle speed such as 58 m.p.h. Should the output voltage exceed the reference voltage, a relay is actuated which in turn either opens or closes a solenoid valve depending upon the particular application of the device.

The output of the frequency-voltage converter may also be used to operate an electronic speedometer and thereby provide greater accuracy than is presently available with mechanical units. Some hysteresis may be included in the comparator unit such that the activation of the relay and concomitant fuel interruption will initially take place at 58 m.p.h. but will not resume until the vehicle speed has dropped to a lower level; for example, 55 m.p.h. Also, a warning light may be utilized such that when the relay is activated, the light glows on the dashboard thereby serving to assure the operator of the vehicle that the power loss is due to operation of the speed limiting device rather than any malfunction in the vehicle itself.

In general, the solenoid valve is mounted between the pump and the injector nozzles and serves to divert a major portion of the flow back upstream of the pump. A small portion of the fuel flow is allowed to continue to the injectors. This substantially reduced amount and pressure serves to lubricate and insure the longevity of the injectors. The continued flow though the pump via the feedback circuit of the valve also insures that the pump will remain lubricated and prevent seizing therein.

DESCRIPTION OF THE DRAWING FIGURES

Figure 4:
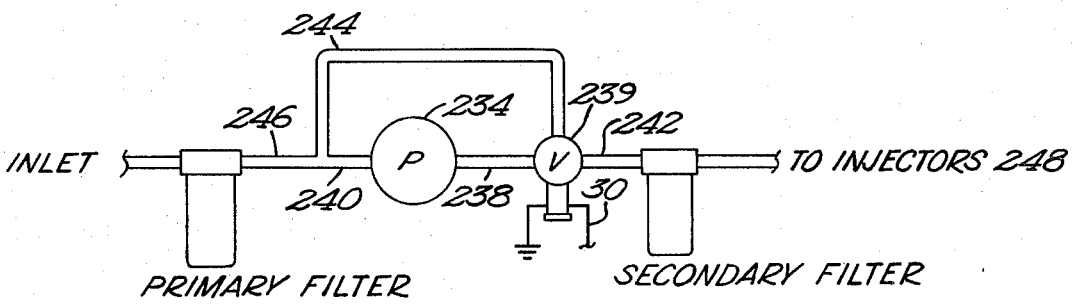

FIG. 4 discloses yet another embodiment of the instant invention.

DESCRIPTION OF THE PREFERRED EMBODIMENT

Figure 1:
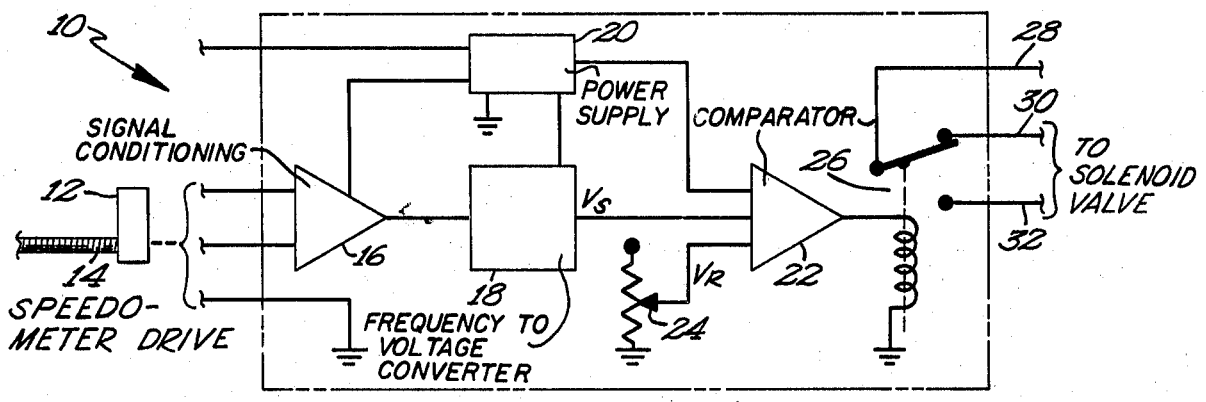
FIG. 1 is a schematic of the control mechanism for the device.

Referring to FIG. 1, the speed control box, generally 10 may be mounted at any point where it is convenient to mount such a unit. A D.C. pulse generator 12 is mounted to the speedometer pickup point 14 which is generally located on either the front wheel or the transmission of an over-the-road truck. The output from the pulse generator is fed via cable to a signal conditioning unit 16 which removes extraneous noise, etc. from the generator 12 output signal. Such conditioning is well known in the art and does not in and of itself comprise part of this invention.

A power supply 20 is mounted in the control unit 10 and supplies power to all of the components therein as shown in FIG. 1. The output of the signal conditioning unit 16 is fed to a frequency-to-voltage converter 18 which changes the signal to a constant voltage which is proportional to the speed of the vehicle. The output voltage $V_S$ of converter 18 is then fed to comparator unit 22. A reference voltage $V_R$ is produced by variable resistor 24, the reference voltage $V_R$ corresponding to the predetermined speed to which it is desired to limit the vehicle. If it is desired to cut the cost of the unit and not have this predetermined speed adjustable, it is of course appreciated that a fixed referenced voltage may be produced.

When the vehicle speed exceeds the predetermined speed, in the preferred embodiment 58 m.p.h., the output voltage $V_S$ of converter 18 will exceed the reference voltage $V_R$ produced by resistor 24 and comparator 22 will then activate relay 26. In the inactivated position, (shown in FIG. 1) a source of power 28 is normally connected to lead 30. When relay 26 is activated however, lead 32 becomes live and lead 30 is rendered dead.

Hysteresis is provided in comparator 22 such that relay 26 becomes activated thereby interrupting the fuel supply at a vehicle speed of 58 m.p.h., the relay will not return to its inactive state until the vehicle speed has dropped to 55 m.p.h. Also, a warning light may be provided and wired to the output of comparator 22 such that when the relay 26 is activated, the warning light will show that the speed limiting device is in operation and that the apparent loss in power and speed perceived by the operator is due to the speed control device rather than a vehicle malfunction.

The output of converter 18 may also be used to drive an electronic speedometer (not shown). Such a device is essentially a volt meter having markings corresponding to vehicle speed. Such a speedometer is of course more accurate and trouble free than the conventional cable-driven mechanical mechanism. While such a device might not normally be economical, the provision of the circuitry for the speed-limiting device makes the electronic speedometer a simple and inexpensive addition.

Figure 2:
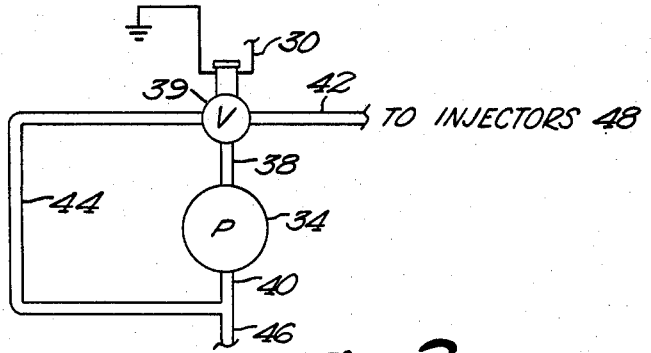
FIG. 2 shows the solenoid valve and its installation on a truck fuel system.

The operation of the embodiments shown in FIGS. 2 and 4 is substantially the same and hence will be discussed together. Diesel fuel arrives from the tank or other source through conduit 46 which splits at a junction into pump inlet conduit 40 and bypass conduit 44. The fuel then passes through pump 34 and pump outlet conduit 38 which is connected to the inlet of solenoid valve 39. Solenoid valve 39 has first and second outlets which are connected to injector conduit 42 and bypass conduit 44 respectively. Injector conduit 42 is connected to injector nozzles 48, a normal part of the engine. Pressure in line 42 during the normal operating mode is on the order of 250 to 300 pounds per square inch. When solenoid valve 39 is in its first or normal operating position, all of the flow from line 38 passes through and to line 42 with no decrease in flow or pressure. Solenoid valve 39 is considered normally closed, that is in the absence of an electrical signal, the valve will be "closed" and in the second position as discussed hereinafter. Solenoid valve 39 is connected to lead 30 of the control box. Input 28 (shown in FIG. 1) to the control box is live when the ignition to the vehicle is on hence when relay 26 is not activated, power will flow through lead 30 to solenoid valve 39 and the valve will be in its first or open position allowing normal flow to the injectors. When the vehicle speed exceeds the predetermined limit, relay 26 will be activated and lead 30 will go dead thus causing solenoid valve 39 to move to the second position. In that position, a great majority of the fuel flow is diverted through bypass conduit 44 and circulates essentially in a loop through the pump 34 valve 39 and bypass conduit 44. In the second position, however, a small amount of fuel is bled into injector line 42 to the injectors. In doing so, proper lubrication and operation of the injection nozzles is assured while at the same time significantly decreasing the amount of fuel to the injectors such that the desired decrease in speed will take place. It is important that the pressure in line 42 during the speed control operation be maintained at a level of at least 18 pounds per square inch. This bleed-off to the injectors during the speed control phase can be accomplished in several ways which would be apparent to one skilled in the art. For example, a very restricted passage could be placed in the body of valve 39 such that when valve 39 assumed the second position, a small amount of fuel would be bled into line 42. Alternatively, a restricted line could be routed directly from line 38 to line 42 such that the by-pass was open at all times and such that a simple two-position valve 39 could be utilized. The application of the system as shown in FIG. 2 shows the hook up of the device on a Cummins Diesel.

Figure 3:
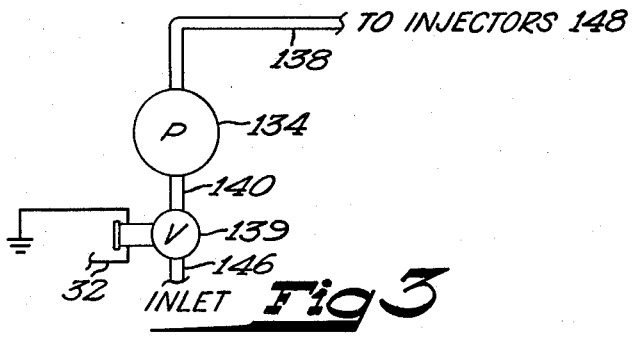
FIG. 3 shows another embodiment of the invention.

The embodiment shown in FIG. 4 operates substantially identically to the embodiment shown in FIG. 2 and is applied to a Detroit Diesel. Analogous parts in FIGS. 3 and 4 are numbered with the same final two digits as FIG. 2 with the first digit being different to denote the respective embodiments. Thus the inlet line 246 downstream from the primary filter tees into pump inlet line 240 and bypass line 244. Pump inlet 240 is connected to pump 234 which has an outlet 238. Pump outlet 238 is thence connected to valve 239 which is also connected to bypass line 244 in a manner as described in FIG. 2. Again, solenoid valve 239 is connected to lead 30 from the control box 10. Valve outlet 242 is thence connected to the upstream side of the secondary filter which then leads to the injector nozzles 248 as shown.

The embodiment shown in FIG. 3 is designed for use with the Mack and Cat Diesels which do not require lubrication of the injector nozzles of the pump for proper operation. Toward this end, a simple solenoid valve 139 is interposed between the fuel inlet 146 and pump inlet line 140. Pump 134 then outputs through line 138 to the injectors 148. Solenoid valve 139 has a first position which is fully open and passes flow directly through the valve in a second position which fully closes valve 139. Solenoid valve 139 is of the normally open type wherein when not energized, the valve is in the first or open position. Valve 139 is connected to lead 32 from control box 10 such that when the predetermined vehicle speed is exceeded, relay 26 will be activated and lead 32 will be energized thereby energizing solenoid valve 139 and shutting off the flow into pump inlet line 140.

While the preferred embodiments of the present invention have been described, it is understood that various changes, adaptations, and modifications may be made therein without departing from the spirit of the invention and the scope of the appended claims.

What is claimed is:

1. A Vehicle Speed Limiting Device for use with diesel vehicles having fuel injection systems, said speed limiting device comprising:

means for measuring the speed of said vehicle;

means for comparing the output of said vehicle speed measuring means to a predetermined speed; and means responsive to said comparing means for interrupting of fuel flow through said injection system when said vehicle speed exceeds said predetermined speed, said interrupting means comprising a valve having an inlet and selectable first and second outlets, said injection system having a fuel pump and injector nozzles, said fuel pump having an inlet and an outlet, said valve inlet being connected to said pump outlet, said valve first outlet being connected to said injector nozzles and said valve second outlet being connected to said pump inlet and said injector nozzles, said second outlet directing a minimal amount of fuel to said nozzles and a great majority of the fuel to said pump inlet, said minimal amount having a pressure of at least 18 p.s.i.

2. A Vehicle Speed Limiting Device of claim 1 wherein said vehicle has a speedometer drive and said measuring means comprises a D.C. pulse generator connected to said speedometer drive.

3. A Vehicle Speed Limiting Device of claim 2 wherein said measuring means further comprises a frequency-to-voltage converter connected to said pulse generator, said converter producing an output voltage corresponding to said vehicle speed.

4. A Vehicle Speed Limiting Device of claim 3 wherein said comparing means includes means for producing a reference voltage corresponding to said predetermined speed.

5. A Vehicle Speed Limiting Device of claim 4 wherein said interrupting means further comprises means for providing a hysteresis effect so that when said interrupting means becomes operative normal fuel flow is not resumed until said vehicle speed drops a predetermined level below said predetermined speed.

* * * * *